US007311085B2

(12) United States Patent
Ogawa et al.

(10) Patent No.: US 7,311,085 B2
(45) Date of Patent: Dec. 25, 2007

(54) ELECTROMAGNETIC CONTROLLED FUEL INJECTION APPARATUS

(75) Inventors: Hisao Ogawa, Sagamihara (JP); Takashi Kaneko, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 54 days.

(21) Appl. No.: 11/318,489

(22) Filed: Dec. 28, 2005

(65) Prior Publication Data

US 2006/0191517 A1 Aug. 31, 2006

(30) Foreign Application Priority Data

Feb. 28, 2005 (JP) ..... 2005-054677

(51) Int. Cl.
*F02M 37/04* (2006.01)

(52) U.S. Cl. ..... 123/495; 123/506

(58) Field of Classification Search ..... 123/506, 123/500, 510, 299, 300
See application file for complete search history.

(56) References Cited

U.S. PATENT DOCUMENTS

| | | | | |
|---|---|---|---|---|
| 4,428,346 | A * | 1/1984 | Hoshi | 123/450 |
| 4,445,822 | A * | 5/1984 | Hoshi | 417/388 |
| 4,831,986 | A | 5/1989 | Linder et al. | |
| 4,976,236 | A * | 12/1990 | Brunel | 123/300 |
| 5,460,133 | A * | 10/1995 | Perr et al. | 123/446 |
| 5,771,865 | A | 6/1998 | Ishida | |
| 6,062,194 | A | 5/2000 | Schwarz et al. | |
| 6,526,947 | B2 * | 3/2003 | Shimada et al. | 123/495 |
| 2005/0133001 | A1 | 6/2005 | Kaneko | |
| 2005/0143898 | A1 | 6/2005 | Kaneko et al. | |
| 2005/0189511 | A1 | 9/2005 | Ogawa et al. | |
| 2005/0189512 | A1 | 9/2005 | Kaneko | |
| 2005/0217638 | A1 | 10/2005 | Kaneko | |

FOREIGN PATENT DOCUMENTS

| | | |
|---|---|---|
| DE | 41 18 237 A1 | 12/1991 |
| DE | 101 55 674 A1 | 5/2003 |
| GB | 1 305 930 | 2/1973 |
| WO | WO02/004805 A1 | 1/2002 |

* cited by examiner

*Primary Examiner*—Thomas Moulis
(74) *Attorney, Agent, or Firm*—Birch, Stewart, Kolasch & Birch, LLP

(57) ABSTRACT

An electromagnetic controlled fuel injection apparatus is provided in which a housing assembly with two sets each including a solenoid device and an open/close valve device being fixed directly to a housing is fixed to a plunger unit to decrease the length of the fuel passages between the open/close valve devices and a plunger room in order to increase the speed of injection response in two-stage fuel injection for reducing NOx emission while maintaining engine performance and to facilitate mounting of the apparatus on constricted space of an engine.

6 Claims, 6 Drawing Sheets

ELECTROMAGNETIC CONTROLLED FUEL INJECTION APPARATUS

BACKGROUND OF THE INVENTION

1. Field of the Invention

The present invention relates to a structure of an electromagnetic controlled fuel injection apparatus using a unit injection pump composed such that fuel injection timing thereof is controlled by means of an open/close valve which is reciprocated by a solenoid device to open or close the passage between the fuel passage communicating with the plunger room where fuel is received and compressed and the spill passage connecting to the fuel return line.

2. Description of the Related Art

An electromagnetic controlled unit injection pump applied to a diesel engine is composed such that fuel injection timing is controlled through shutting-off/allowing communication of the fuel passage connecting to a plunger room where fuel is introduced and compressed with the spill passage connecting to the fuel return line by closing/opening a poppet valve reciprocated by means of a solenoid device.

Two stage fuel injection consisting of initial injection and primary injection has been proposed for a diesel engine equipped with an electromagnetic controlled fuel injection apparatus like this in order to reduce NOx(nitrogen oxide) and improve combustion efficiency.

An electromagnetic controlled unit injection apparatus has been proposed, which is composed to perform two stage fuel injection like this by providing two solenoid devices for one plunger unit as shown in FIG. 5.

In FIG. 5, reference numeral 40 is a plunger unit, in which fuel fed into a plunger room 6 is compressed to high pressure by a plunger 5 reciprocating in a barrel 7 for the compressed fuel to be supplied to a fuel injection nozzle not shown in the drawing.

Reference numerals 20 are two solenoid devices connected to said plunger unit 40, reference numerals 011 are poppet valve devices accommodated in valve cases 012 and reciprocated by the solenoid devices 20. The plunger room 6 of the plunger unit 40 is communicated to the poppet valve devices 011 through fuel passages bored in the barrel 7 of the plunger unit 40 and by means of fuel pipes 015. Reference numerals 013 are spill passages for spilling fuel to flow out.

In the unit injection pump like this, fuel injection timing is controlled by opening/closing the poppet valves of the poppet valve devices 011, the poppet valves being reciprocated by switching the state of the solenoid devices 20 between excited and non-excited state to be opened/closed for shutting-off/allowing communication of the passages in the fuel pipes 015 and fuel passages 014, which communicate with the plunger room 6 where fuel is introduced and compressed by the reciprocation of the plunger 5 of the plunger unit 40, with the spill passages 013 connecting to the fuel return line.

Two-stage injection consisting of initial injection and primary injection is realized by a single plunger unit through causing time difference between the opening/closing timing of the two poppet valve devices 011 by changing the timing of switching between excited and non-excited state of the two solenoid devices.

In JP7-269438A is disclosed an electromagnetic controlled fuel injection apparatus, in which the opening stroke of the poppet valve is increased at the injection end to allow a rapid pressure drop at the injection end so as to sharpen injection cutoff, while the closing stroke of the poppet valve is shortened.

In the conventional electromagnetic controlled unit injection pump shown in FIG. 5, a single plunger unit 40 is connected to two assembled units each consisting of a solenoid device 20 and a poppet valve device by means of long fuel passages each consisting of a fuel pipe 015 and a fuel passage 014, so a large space is required for installing the electromagnetic controlled unit injection pump, which involves difficulty to mount the injection pump on the upper surface of the crankcase where space is particularly restricted.

Further, in the conventional electromagnetic controlled unit injection pump, as a single plunger unit 40 is connected to two assembled units each consisting of a solenoid device 20 and a poppet valve device by means of long fuel passages each consisting of a fuel pipe 015 and a fuel passage 014, the speed of response of fuel injection in two-stage injection to the switching of the state of the solenoid devices 20 between excited and non-excited state is lowered, it is difficult to obtain a desirable injection mode of two-stage injection with good injection cutoff, and reduction in NOx(nitrogen oxide) and maintenance of engine performance become difficult.

In said JP7-269438A discloses an electromagnetic controlled fuel injection apparatus with which the opening and closing stroke of the poppet valve are controlled, but does not disclose a means to achieve a two-stage injection mode with good injection cutoff by connecting two assembly units consisting of a solenoid device and poppet valve device to a single plunger unit.

SUMMARY OF THE INVENTION

The present invention was made in light of the problem of the prior art mentioned above, and the object of the invention is to provide an electromagnetic controlled fuel injection apparatus in which a single plunger unit and two sets each consisting of a solenoid device and a poppet valve device are included in a single housing to integrate them into a compact housing assembly so that the housing assembly can be mounted in a restricted space in order that the housing assembly can be easily mounted on the upper face of the crankcase of an engine where space is particularly restricted, and response speed of fuel injection in two-stage fuel injection which is performed by switching the state of the solenoid devices between excited and non-excited state can be increased to reduce NOx emission while maintaining engine performance.

To attain the object, the present invention proposes an electromagnetic controlled fuel injection apparatus composed such that fuel injection timing is controlled through shutting-off/allowing communication of fuel passages, which connect to a plunger room of a plunger unit where fuel is introduced and compressed to high pressure, with spill passages connecting to a fuel return line through opening/closing open/close valves reciprocated by actuation of solenoid devices, wherein two sets each consisting of a solenoid device and an open/close valve are included in a single housing such that both centerlines of said two sets extend perpendicular to the centerline of said plunger unit and radially from a point on said centerline at a certain angle, and the housing incorporated with said two sets of the solenoid device and open/close valve is attached to said plunger unit.

It is preferable in the invention that said housing is configured such that the mounting faces to attach said two solenoid devices are perpendicular to the joining face of said housing and said plunger unit.

According to the invention, as the two sets each consisting of a solenoid device and an open/close valve device are placed in the single housing, the housing is attached to the plunger unit, and preferably the two sets of the solenoid device and open/close valve device are disposed so that both the centerlines of the sets extend perpendicular to the centerline of the plunger unit and further the centerlines extend radially from a point on the centerline of the plunger unit at a certain angle, a single housing assembly integrated compactly with two sets of the solenoid device and open/close valve device can be composed.

By attaching the single, compact housing assembly to the plunger unit, an electromagnetic controlled fuel injection apparatus capable of two-stage injection by actuating the solenoid device and open/close valve device can be composed without providing fuel piping between the open/close valve devices and plunger unit. Therefore, space required for installing the electromagnetic controlled fuel injection apparatus can be substantially decreased in comparison with the case two sets each consisting of a solenoid device and a poppet valve device are connected to a single plunger unit by means of fuel pipes as shown in FIG. 5. Accordingly, the electromagnetic controlled fuel injection apparatus of the invention can be easily mounted even on the upper part of the crankcase where space is particularly constricted.

Further, according to the invention, a compact, single housing assembly with two sets each consisting of a solenoid device and an open/close valve device included therein can be composed by integrating said two sets of the solenoid device and open/close valve device in a single housing so that both the centerlines of the sets are perpendicular to the centerline of the plunger unit and extend radially from a point on the centerline of the plunger unit, and the electromagnetic controlled fuel injection apparatus capable of performing two-stage fuel injection by the actuation of the two sets of the solenoid device and open/close valve device can be composed by attaching the compact, single housing assembly to the plunger unit, so that it is not necessary to connect the open/close valve devices to the plunger room by means of fuel pipes. Therefore, the length of fuel passages to connect the plunger room to the open/close valve devices can be decreased in comparison with the case of FIG. 5 in which each of two sets each consisting of a solenoid device and a poppet valve device are connected to the plunger unit by means of respective pipe, and as a result response speed of injection in two-stage injection performed through switching the state of each of the solenoid device between excited and non-excited state can be increased.

Further, the invention is featured in that said housing is provided therein with fuel passages each for connecting each of said open/close valve devices to the plunger room and to spill passages to be connected to a fuel return line and fixed to said plunger unit by means of high pressure seal bolts so that the joining face of said housing and said plunger unit is fluidly sealed to prevent leakage of the fuel in said fuel passage and said spill passage, and said housing is fixed to the crankcase by means of mounting bolts.

In the invention, it is preferable that a plurality of said high pressure seal bolts are positioned circumferentially equally spaced on a circle around the center of the plunger unit, a plurality of said mounting bolts are positioned circumferentially equally spaced outside of said circle, and one of said mounting bolts is positioned between said two solenoid devices.

According to the invention, as the housing provided with fuel passages to connect the open/close valve devices to the plunger room and to the spill passages can be fixed firmly to the plunger unit by means of a plurality of the high pressure seal bolts preferably positioned circumferentially equally spaced on a circle around the center of the plunger unit so that the joining face of the housing and plunger unit is fluidly sealed, leakage of fuel in the passages can be prevented positively by virtue of strong tightening force of the bolts even when injection pressure is very high.

Further, the housing assembly to which the plunger unit is fixed can be attached to the crankcase by means of a plurality of the mounting bolts and one of the mounting bolts is positioned between the two solenoid devices, so that the mounting bolts can be positioned circumferentially equally spaced and the housing assembly fixed with the plunger unit can be attached firmly to the crankcase with tightening force uniformly distributed to the mounting bolts.

According to the present invention, by incorporating two sets of a solenoid device and an open/close valve device in a single housing such that centerlines of the sets extend radially from a point on the centerline of the plunger unit and perpendicular to the centerline of the plunger unit, a single housing assembly compactly integrating the solenoid devices and open/close valve devices can be composed, and an electromagnetic controlled fuel injection apparatus which can perform two-stage fuel injection through activation of the two sets of the solenoid device and open/close valve device can be provided without need to provide fuel pipe for connecting the plunger room to the solenoid valve devices by fixing the compact, single housing assembly to the plunger unit, so that space for installing the electromagnetic controlled fuel injection apparatus can be substantially decreased in comparison with the case two assembled units each consisting of a solenoid device and a poppet valve device are connected to a single plunger unit by means of fuel pipes. Therefore, the electromagnetic controlled fuel injection apparatus of the invention can be easily mounted even on the upper part of the crankcase where space is particularly limited.

Further, according to the present invention, as an electromagnetic controlled fuel injection apparatus can be provided which can perform two-stage fuel injection by the actuation of the two sets of the solenoid device and open/close valve device by attaching the compact, single housing assembly which includes two sets of the solenoid device and open/close valve device to a single plunger unit, so that it is not necessary to connect the open/close valve devices to the plunger room by means of fuel pipes. Therefore, the length of fuel passages to connect the plunger room to the open/close valve devices can be decreased in comparison with the case in which each of two assembly units each consisting of a solenoid device and a poppet valve device are connected to the plunger unit by means of respective fuel pipe, and as a result response speed of injection in two-stage injection performed through switching the state of each of the solenoid device between excited and non-excited state can be increased.

Accordingly, an injection mode of two-stage injection capable of reducing NOx emission while maintaining engine performance can be achieved.

Further, according to the invention, as the housing provided with fuel passages for connecting the open/close valve devices to the plunger room and to the spill passages to be connected to the fuel return line can be fixed firmly to the plunger unit by high pressure seal bolts positioned circumferentially equally spaced on a circle around the center of the plunger unit, the joining face of the housing to the plunger unit is fluidly sealed and leakage of fuel in the passages can be prevented positively by virtue of strong tightening force of the bolts even when injection pressure is very high.

DETAILED DESCRIPTION OF THE INVENTION

An embodiment of the present invention will now be described in detail with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
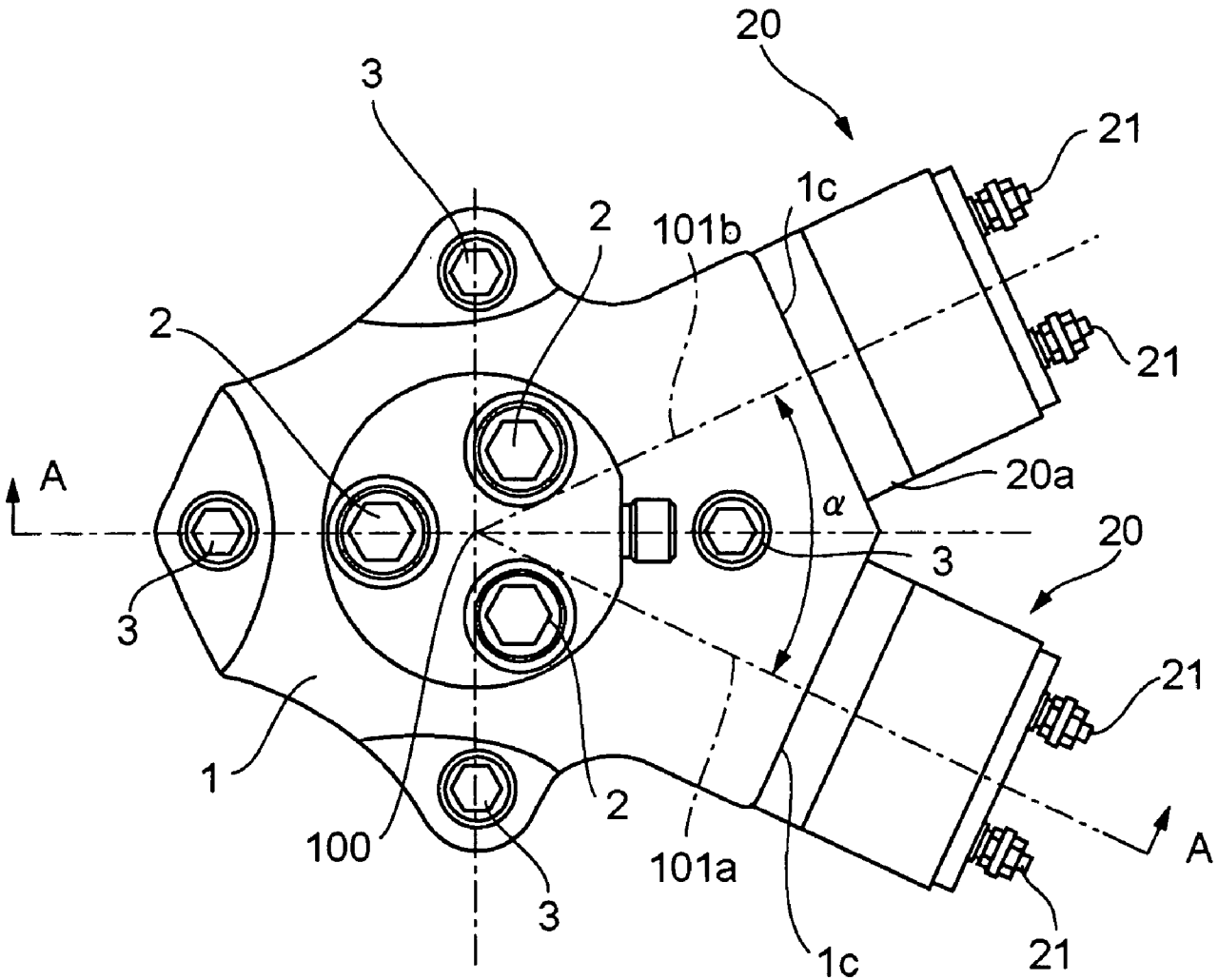
FIG. 1 is a top plan view of an embodiment of the electromagnetic controlled unit injection pump according to the present invention.
Figure 2:
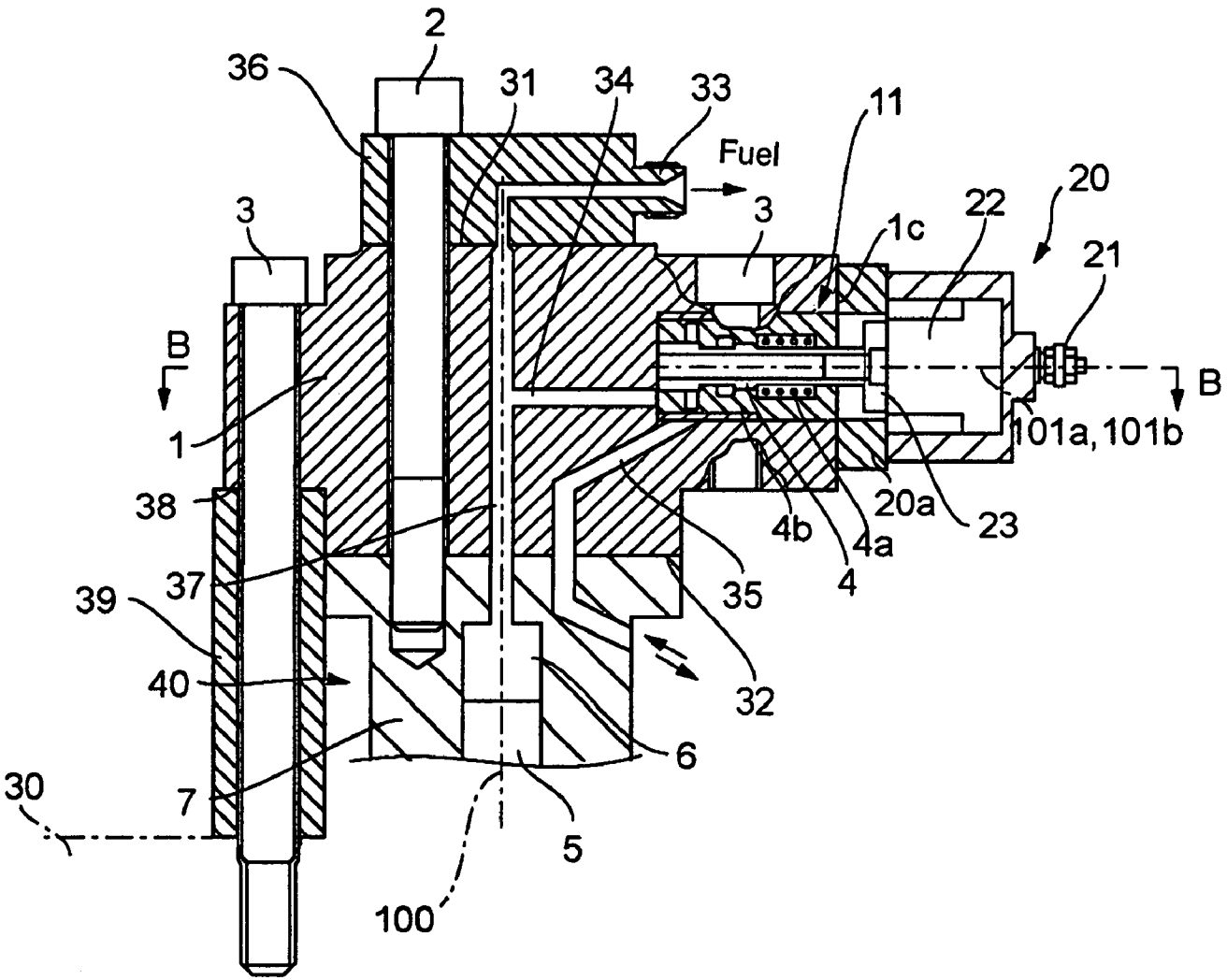
FIG. 2 is a cross-sectional view taken along the line A-A of FIG. 1.
Figure 3:
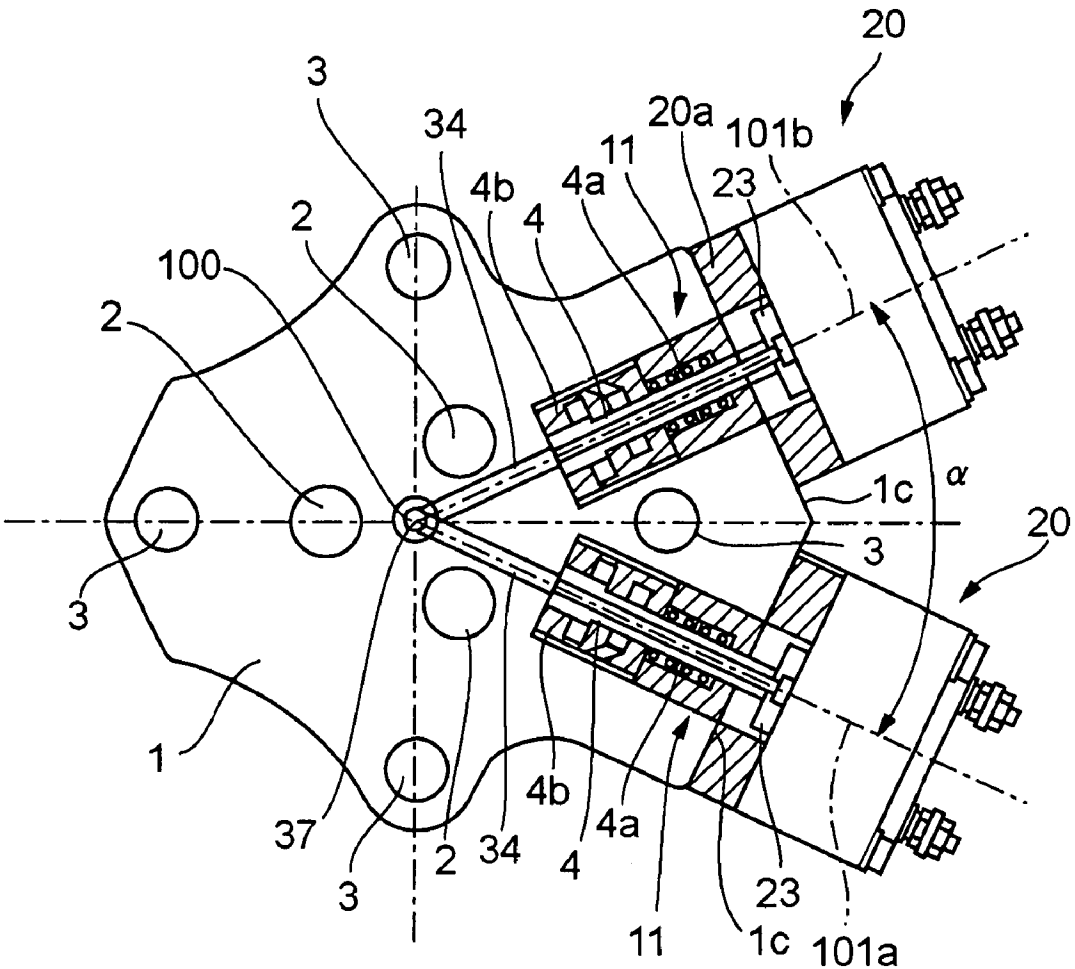
FIG. 3 is a sectional view taken along the line B-B of FIG. 1.
Figure 4:
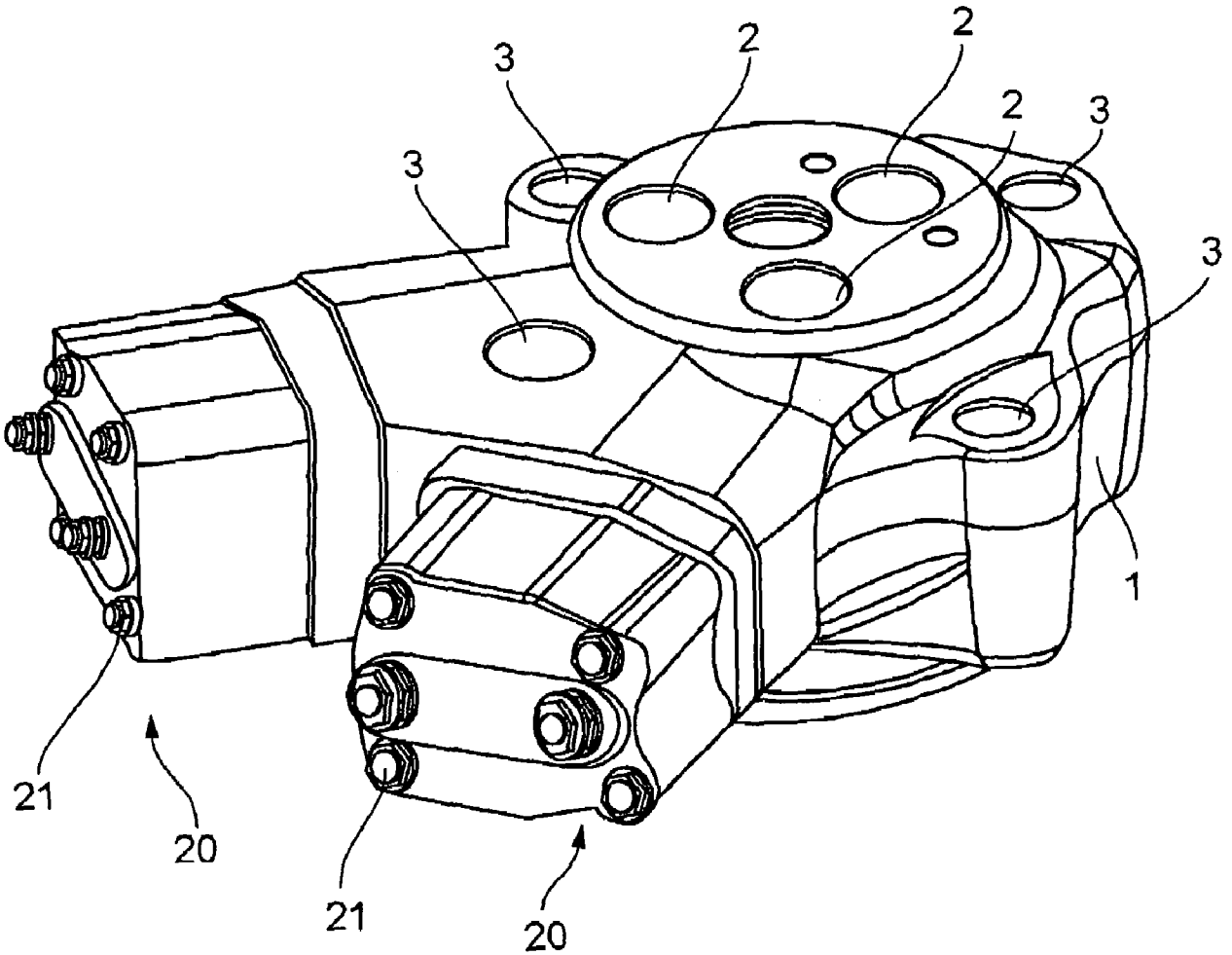
FIG. 4 is a perspective view of the electromagnetic controlled unit injection pump of FIG. 1.

FIG. 1 is a top plan view of an embodiment of the electromagnetic controlled unit injection pump according to the present invention, FIG. 2 is across-sectional view taken along the line A-A of FIG. 1, FIG. 3 is a sectional view taken along the line B-B of FIG. 2, and FIG. 4 is a perspective view of the electromagnetic controlled unit injection pump of FIG. 1.

Referring to FIG. 1~4, reference numeral 40 is a plunger unit for introducing fuel in a plunger room 6 and compressing the fuel therein by a plunger 5 which is reciprocated in a plunger barrel 7 to supply the highly pressurized fuel to an injection nozzle not shown in the drawings.

Reference numeral 1 is a housing, 20 is a solenoid device, 11 is a poppet valve reciprocated by means of the solenoid device 20. In the present invention, two solenoid devices 20 and poppet valve devices 11 are attached to the housing 1, and the housing is attached to the plunger barrel 7 of the plunger unit 40. Reference numeral 36 is a discharge connector fixed to the upper surface of the housing 1.

In the solenoid device 20 and poppet device 11, reference numeral 4 is a poppet valve, 4*b* is a valve seat member in which the poppet valve 40 is fitted for reciprocation, 4*a* is a poppet valve spring.

Reference numeral 22 is an electromagnetic coil of the solenoid device 20, and 23 is an armature which is fixed to the top face of the poppet valve 4 and can be attracted toward the electromagnetic coil 22.

The construction of the solenoid device 20 and that of the poppet valve device 11 are the same as those of conventional devices, and detailed explanation is omitted.

Said two solenoid devices 20, 20 and poppet valve devices 11, 11 are disposed, as illustrated in FIG. 2 and FIG. 3, so that both the centerlines 101*a* and 101*b* of them extend laterally and perpendicularly to the centerline 100 of the plunger unit 40, and the centerlines 101*a* and 101*b*, each being a common centerline of the solenoid device 20 and poppet valve device 11, intersect at the center 100 of the plunger unit 40 at an angle of α so that the center lines 101*a* and 101*b* extend radially from the center 100.

The poppet valve devices 11, 11 are accommodated in the housing 1, armature cases 20*a*, 20*a* inside of which the armature 23 is positioned are fixed to mounting faces 1*c*, 1*c* of the housing 1, the faces being perpendicular to the centerlines 101*a*, 101*b* respectively, and the solenoid devices 20, 20 are fixed to the armature cases 20*a*, 20*a* respectively.

The housing 1 is configured such that the joining face 32 thereof to be joined with the plunger unit 40 and the joining face 31 thereof to be joined with the discharge connector 36 are both perpendicular to the mounting faces 1*c*, 1*c* thereof for attaching the solenoid devices 20, 20.

Reference numerals 21 are bolts for fixing the solenoid devices 20, 20 together with the armature cases 20*a*, 20*a* to the housing 1.

A fuel passage 37 is drilled in the housing 1 along the centerline 100 of the plunger unit 40, the passage communicating the plunger room 7 to the fuel outlet passage 33 in the discharge connector 36. A fuel passage 34 branching from the fuel passage 36 to be communicated to the poppet valve 11 and a spill passage 35 for connecting the spill outlet of the poppet valve 11 to the fuel return line are also drilled in the housing 1.

Reference numerals 2 are high pressure seal bolts. A plurality of the seal bolts 2 (three bolts in the case of the embodiment) are provided circumferentially equally spaced on a circle having as its center the centerline 100 of the plunger unit 40. The bolts tighten the discharge connector 36 together with the housing 1 to the plunger barrel 7 so that the joining face 32 of the plunger barrel 7 with the housing 1 and the joining face 31 of the discharge connector 36 with the housing 1 are fluidly sealed.

Reference numerals 3 are mounting bolts. A plurality of the mounting bolts 3 (four bolts in the case of the embodiment) are positioned circumferentially equally spaced outside the seal bolts 2, and one of the four mounting bolts 3 is located between the two solenoid devices 20, 20.

The plurality of bolts 3 (four in the case of the embodiment) penetrate the housing 1 as illustrated in FIG. 2 and tighten the housing 1 together with a pump case 39 by way of a joining face 38 to the crank case 30 of the engine not shown in the drawing.

In operation of a diesel engine equipped with the electromagnetic controlled unit injection pump like this, fuel is introduced to the plunger room 6 and compressed to high pressure therein by the reciprocation of the plunger 5 driven by a fuel cam of the engine(not illustrated).

Then, when the armature 23 to which the poppet valve 4 is fixed is attracted toward the electromagnetic coil 22 of the solenoid device 20 by exciting the solenoid device 20, the seating part between the poppet vale 4 and valve seat member 4*b* is closed, and in the plunger room 6, the fuel passages 37 and 34, and the fuel passage communicating with the injection nozzle not shown the pressure of the fuel rises.

When the fuel pressure exceeds the opening pressure of the injection nozzle, the needle valve is opened and the high pressure fuel is injected into the combustion chamber, the injection nozzle, needle valve, and combustion chamber being not illustrated.

Then, when the solenoid device 20 is deexcited, the armature 23 is moved to the left in FIG. 2 by the spring force of the poppet valve spring 4*a*, a seat passage is formed between the seat parts of the poppet valve 4 and valve seat member 4*b*, and the fuel in the plunger room 6 is discharged to the spill passage 35 through said seat passage and the fuel passage 37 and 34.

Figure 6:
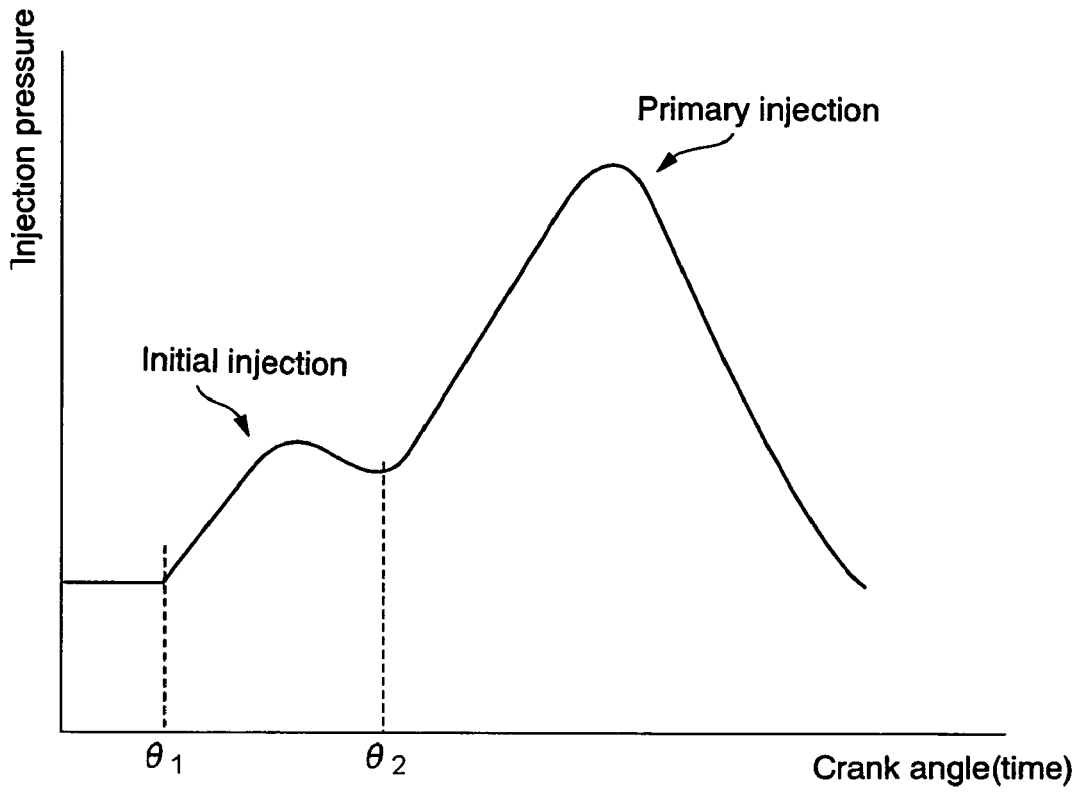
FIG. 6 is an injection pressure diagram of the electromagnetic controlled unit injection pump of FIG. 1.

Two-stage fuel injection consisting of initial injection which begins from θ1 and primary injection which begins from θ2 as shown in FIG. 6 is realized through causing time difference between the opening/closing timing of the two poppet valves devices 11 by changing the timing of switching between excited and non-excited state of the two solenoid devices 20, 20.

According to the embodiment, a single housing attached with two solenoid devices 20 and two poppet valves 11 is attached to the plunger unit 40 such that both the centerlines 101*a* and 101*b* of each of the two solenoid devices 20, 20 and poppet valve devices 11, 11 are disposed laterally and perpendicular to the centerline 100 of the plunger unit so that the centerlines 101*a*, 101*b* of the solenoid devices and poppet valve devices extend radially from a point on the centerline of the plunger unit 40 at a central angle of α, so a housing assembly unit can be compactly composed with two solenoid devices 20, 20 and poppet valve devices 11 being integrated therein.

Figure 5:
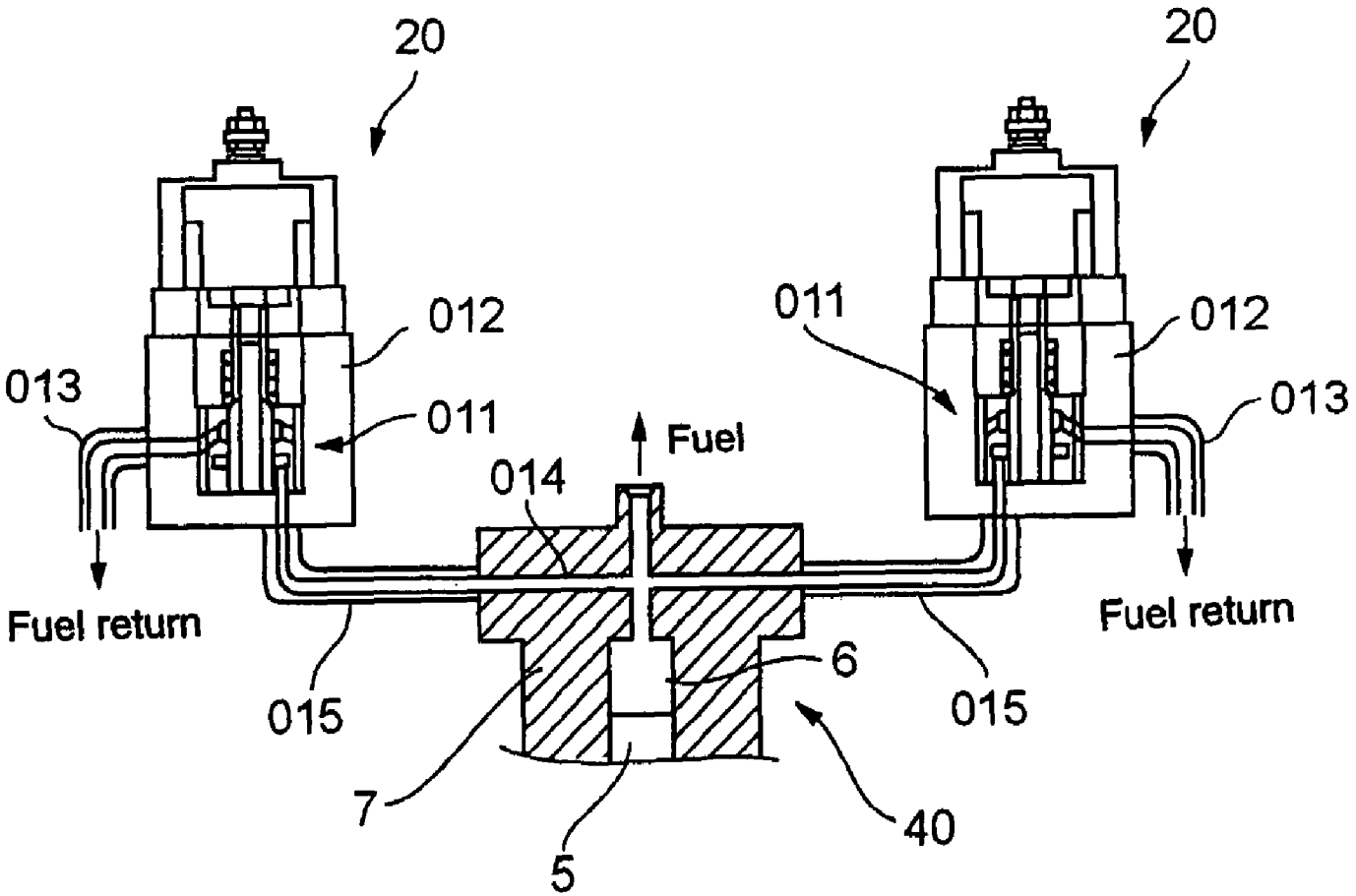
FIG. 5 is a fragmentary sectional view of a conventional electromagnetic controlled unit injection pump.

By attaching a single housing assembly unit of compact construction like this to the plunger unit 40, an electromagnetic controlled unit injection pump can be composed which can perform two-stage fuel injection by virtue of two solenoid devices 20, 20 and poppet valves 11, 11, without providing additional fuel piping. Thus, the space for mounting the unit injection pump can be substantially decreased in comparison with the case of the conventional structure in which two assembly units of a solenoid device and poppet valve device are connected to a single plunger unit as illustrated in FIG. 5, and the electromagnetic controlled unit injection pump can be easily mounted even on the upper surface of the crankcase 30 where space is particularly restricted.

Further, according to the invention, as mentioned above, a single housing assembly which compactly integrates two sets of the solenoid device 20 and poppet valve device 11 can be composed by attaching said two sets of the solenoid device 20 and poppet valve device 11 to the one plunger unit 40 such that the centerline 101*a* and 101*b* of said two sets are disposed to extend radially and laterally from the center 100 of the plunger unit 40. Therefore, by attaching the compact, single housing assembly to the plunger unit 40, an electromagnetic controlled unit injection pump capable of performing two-stage injection by virtue of two sets each consisting of a solenoid device 20 and a poppet valve device 11, so that such fuel pipes 015 as illustrated in FIG. 5 of a conventional art are not necessary, as a result fuel passage length from the plunger room to each of the poppet valves can be shortened in comparison with the prior art of FIG. 5 in which two sets of solenoid device and poppet valve device are connected to one plunger unit by fuel pipes 015. Accordingly, response speed of two-stage fuel injection which is performed by switching the state of the solenoid device 20, 20 between excited and non-excited state can be increased.

Further, according to the invention, as the discharge connector 36 and the housing 1 provided with the fuel passages 34, 37, and spill passage 35 can be fixed firmly to the plunger unit 40 with the high pressure seal bolts 2 (three bolts in the case of the embodiment) positioned circumferentially equally spaced around the center 100 of the plunger unit 40 so that their joining faces 32, 31 are fluidly sealed, fuel leak at the joining faces can be positively prevented by virtue of strong tightening force of the high pressure seal bolts 2, thus fuel seal structure capable of enduring high pressure fuel injection can be obtained.

Further, as the housing 1 is tightened to the crank case 30 together with the pump case 39 by way of the joining face 38 with a plurality of mounting bolts 3(four bolts in the case of the embodiment) penetrating the housing 1 from upper face thereof, the compact, single housing assembly attached with the two sets of the solenoid device 20 and poppet valve device 11 can be fixed together with the plunger unit 40 to the crankcase 30 with the mounting bolts 3, and in addition, by positioning one of the mounting bolts 3 between the two solenoid devices 20, 20, a plurality of the bolts 3 (four bolts) can be located circumferentially equally spaced and as a result the housing assembly and plunger unit 40 can be fixed firmly with evenly distributed tightening force.

Above embodiment is a case the present invention is applied to an electromagnetic controlled unit injection pump, the invention can be applied widely to electromagnetic controlled fuel injection apparatus with which injection timing is controlled by means of solenoid devices.

According to the present invention, a single plunger unit and two sets each consisting of a solenoid device and a open/close valve device are included in a single housing to integrated them into a compact housing assembly so that the housing assembly can be mounted in a restricted space, so that the housing assembly can be easily mounted on the upper face of the crankcase of an engine where space is particularly restricted, and response speed of fuel injection in two-stage fuel injection which is performed by switching the state of the solenoid devices between excited and non-excited state can be increased. Therefore, an electromagnetic controlled fuel injection apparatus can be provided with which reduction in NOx emission can be achieved while maintaining engine performance.

What is claimed:

1. An electromagnetic controlled fuel injection apparatus composed such that fuel injection timing is controlled through shutting-off/allowing communication of fuel passages which connect to a plunger room of a plunger unit where fuel is introduced and compressed to high pressure, with spill passages adapted to be connected to a fuel return line through opening/closing open/close valves reciprocated by actuation of solenoid devices, wherein two sets each including a solenoid device and an open/close valve are included in a single housing such that both centerlines of said two sets extend perpendicular to a centerline of said plunger unit and radially from a point on said centerline at an angle, such that a center line of one of the two sets is not parallel with a center line of the other of the two sets, and the housing incorporated with said two sets of the solenoid device and open/close valve is attached to said plunger unit.

2. The electromagnetic controlled fuel injection apparatus according to claim 1, wherein said housing is configured such that the mounting faces to attach said two solenoid devices are perpendicular to the joining face of said housing and said plunger unit.

3. The electromagnetic controlled fuel injection apparatus according to claim 1, wherein said housing is provided therein with fuel passages each for connecting each of said open/close valve devices to the plunger room and spill passages to be connected to a fuel return line and fixed to said plunger unit by means of high pressure seal bolts so that the joining face of said housing and said plunger unit is fluidly sealed to prevent leakage of the fuel in said fuel passage and said spill passage, and said housing is fixed to the crankcase by means of mounting bolts.

4. The electromagnetic controlled fuel injection apparatus according to claim 3, wherein a plurality of said high pressure seal bolts are positioned circumferentially equally spaced on a circle around the center of the plunger unit, a plurality of said mounting bolts are positioned circumferentially equally spaced outside of said circle, and one of said mounting bolts is positioned between said two solenoid devices.

5. The electromagnetic controlled fuel injection apparatus according to claim 1, wherein the two sets are disposed away from said centerline.

6. An electromagnetic controlled fuel injection apparatus composed such that fuel injection timing is controlled through shutting-off/allowing communication of fuel passages which connect to a plunger room of a plunger unit where fuel is introduced and compressed to high pressure, with spill passages adapted to be connected to a fuel return line through opening/closing open/close valves reciprocated by actuation of solenoid devices, wherein two sets each including a solenoid device and an open/close valve are included in a single housing such that both centerlines of said two sets extend perpendicular to a centerline of said plunger unit and radially from a point on said centerline at an angle, and the housing incorporated with said two sets of the solenoid device and open/close valve is attached to said plunger unit, wherein said housing is provided therein with fuel passages each for connecting each of said open/close valve devices to the plunger room and spill passages to be connected to a fuel return line and fixed to said plunger unit by means of high pressure seal bolts so that the joining face of said housing and said plunger unit is fluidly sealed to prevent leakage of the fuel in said fuel passage and said spill passage, and said housing is fixed to the crankcase by means of mounting bolts, and wherein a plurality of said high pressure seal bolts are positioned circumferentially equally spaced on a circle around the center of the plunger unit, a plurality of said mounting bolts are positioned circumferentially equally spaced outside of said circle, and one of said mounting bolts is positioned between said two solenoid devices.

* * * * *